United States Patent [19]

Nehra

[11] 4,296,181

[45] Oct. 20, 1981

[54] PLATING METHOD AND STRUCTURE

[76] Inventor: Samuel A. Nehra, 12 Lake Shore La., Grosse Pointe Shores, Mich. 48236

[21] Appl. No.: 112,468

[22] Filed: Jan. 16, 1980

[51] Int. Cl.[3] ..... C23C 7/00

[52] U.S. Cl. ..... 428/626; 427/404; 427/406; 427/423; 427/427; 428/646; 428/647; 428/648; 204/38 B; 204/41; 204/30

[58] Field of Search ..... 427/427, 404, 406, 423, 427/316, 322; 204/38 B, 41, 30; 428/625, 626, 647, 646, 648

[56] References Cited

U.S. PATENT DOCUMENTS

| | | | |
|---|---|---|---|
| 1,261,141 | 4/1918 | Luense | 204/38 B |
| 1,738,748 | 12/1929 | Wirshing et al. | 204/38 B |
| 1,790,213 | 1/1931 | Gwaltney | 204/30 |
| 1,923,790 | 8/1933 | Moore | 204/38 B |
| 2,683,436 | 7/1954 | Marantz | 118/72 |
| 3,010,843 | 11/1961 | Eder | 427/319 |
| 3,188,186 | 6/1965 | Durham | 204/41 |
| 3,716,462 | 2/1973 | Jensen | 204/38 B |
| 3,888,746 | 6/1975 | Uy | 204/38 B |

FOREIGN PATENT DOCUMENTS

| | | | |
|---|---|---|---|
| 207544 | 2/1924 | United Kingdom | 204/38 B |
| 362608 | 12/1931 | United Kingdom | 204/38 B |

OTHER PUBLICATIONS

Engel, Metal Finishing Manual, The Iron Age (1948) p. 1.

Donakowski, Brass Plating for Improved Bumper Durability, Plating, Nov. 1971, pp. 1094–1098.

*Primary Examiner*—Ralph S. Kendall

*Attorney, Agent, or Firm*—Whittemore, Hulbert & Belknap

[57] ABSTRACT

A plated member and method of producing the member. The plated member includes a chrome plating over a tin zinc sprayed coating on a prepared surface. The member is produced by acid stripping, cleaning, baking and re-cleaning the member to prepare the surface thereof, subsequently spray coating the prepared surface with a tin zinc material, abrading the surface of the tin zinc coated member to the desired form, and plating the cleaned, coated and abraded surface with two copper, two nickel and one chromium layers.

4 Claims, 2 Drawing Figures

PLATING METHOD AND STRUCTURE

BACKGROUND OF THE INVENTION

1. Field of the Invention

The invention relates to metal plating and metal plated parts and refers more specifically to restoring antique metal parts for automobiles and the like by cleaning the parts, spray coating them with a tin zinc mixture, followed by plating them with layers of copper nickel and chromium and the metal plated parts so produced.

2. Description of the Prior Art

In the past, metal coating of previously metal coated articles such as chrome plated antique automobile parts and the like has been accomplished by buffing the parts, heavily copper plating the parts, rebuffing and then re-chroming the buffed parts. Such procedure has been unsatisfactory where the metal to be plated has been severely worn or pitted, or has otherwise deteriorated causing loss of detail.

SUMMARY OF THE INVENTION

The invention comprises plated metal articles and the method of plating them. The articles have a cleaned and baked surface to be plated. The cleaned and baked surface to be plated is spray coated with a layer of tin zinc material. The tin zinc coating is chrome plated. The plated metal of the invention is produced by the steps of first cleaning the article to be plated, baking the article to remove moisture and entrapped gases from chemical degradation therefrom, spray coating the cleaned and recleaned baked article with a tin zinc material, and subsequently abrading the tin zinc coating to a desired form, and plating the abraded tin zinc surface of the article.

DESCRIPTION OF THE PREFERRED EMBODIMENT

Figure 1:
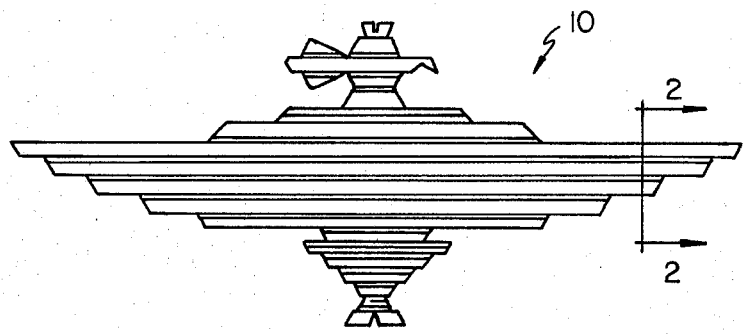
FIG. 1 is a plan view of an antique automobile part to be plated.
Figure 2:
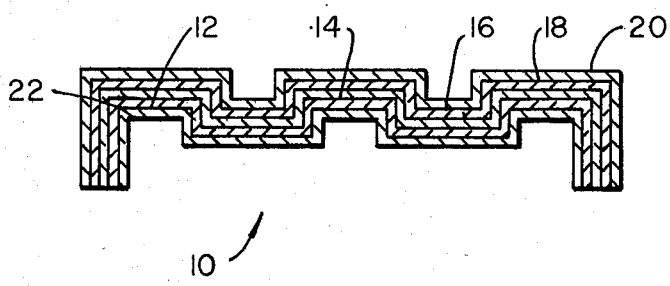
FIG. 2 is an enlarged cross section of the antique automobile part to be plated shown in FIG. 1, taken substantially on the line 2—2 in FIG. 1.

In accordance with the invention, an antique automobile part 10 to be chrome plated is first acid stripped, that is, the part 10 is dipped in an acid bath and stripped with an electric current in accordance with accepted procedures. The acid bath may be dilute sulphuric acid.

The acid stripped metal part 10 is then cleaned with glass frit, glass beads or sand. The glass frit cleaning of the part 10 can be accomplished, for example, in an air blast cabinet. Residual dirt may be blown from the now stripped and glass frit cleaned part 10.

The stripped and cleaned part is then baked in an over for approximately one-half hour at approximately 350° F. The baking removes moisture from the surface and entrapped gases from chemical degradation from the interior of the part 10. This step is necessary to prevent imperfections in the subsequent metal coatings.

The part 10 is then again blasted with glass beads, glass frit or sand, and blow clean with dry air. The part should not be handled with the bare hand to prevent surface degradation from skin acids or moisture.

At this time, the metal part 10 may be sealed from air, as in a plastic container or wrapping, until it is subsequently desired to plate the metal part.

When it is desired to plate the metal part, the metal part is removed from its plastic container or wrapper and is arc flame sprayed or flame sprayed with a tin zinc material to a thickness of four or more mils. The tin zinc material is preferably more than 50% tin by weight. An 80/20 tin zinc material has been found to be particularly desirable. A 60/40 tin zinc material is adequate but less desirable than the 80/20 tin zinc material.

The stripped, cleaned and spray coated part 10 is then abraded by filing with a coarse file in areas in which it is desired to reshape the repaired, worn or deteriorated surfaces. Subsequently, the tin zin surfaces of the part are further abraded, using a mill file and then a wet sanding process using #220-600 sandpaper.

The part is then provided with a chrome plating which may include a copper cyanide underplate 14, bright copper plate 16, a semi-bright nickel plate 18, a bright nickel plate 20, and a subsequent chrome plate 22.

The product of the invention then is a metal part 10 having an acid stripped, glass bead, glass frit or sand cleaned, baked surface 24 which has subsequently been cleaned again and spray coated with a tin zinc material of more than 50% tin which is preferably a 80/20 tin zinc material. The metal plated article of the invention further has a filed and sanded surface on the tin zinc coating which is subsequently chrome plated by successive layers of copper cyanide, bright copper, semibright nickel, bright nickel, and chrome layers.

It has been found that surfaces so plated may be subjected to salt spray, humidity, freeze-thaw cycling, heat shock, impact, outdoor exposure, and the like, and will perform satisfactorily under all such known tests. Further, the product of the invention produced by the method of the invention as set forth above, exceeds any standards for chrome plated automobile parts known to date.

Further, through the method of the invention, and particularly in view of the spray coating of parts prior to re-chroming them, badly deteriorated parts can be restored, that is, pits removed, voids filled and faulty metal repaired for subsequent plating. Further, the method of the invention is simple, economical and efficient, as compared to the current buffing and chrome plating of such articles.

While one embodiment of the invention has been considered in detail, it will be understood that other embodiments and modifications are contemplated.

Thus, for example, while the metal plated structure and method for producing it disclosed are particularly suited for restored antique auto parts and restoration of antique auto parts, both the structure and method of the invention have application to otherparts to be plated, particularly when the parts have deteriorated prior to plating.

Further the structure and method of the invention may include or be used to produce a metallized surface over a specially treated plastic such as one treated with a special primer or adhesive, for example, reacted epoxy or a polyester epoxy. The metallized surface may then be buffed and chrome plated in the manner described above.

The process may also be used over an aluminum or steel substrate to cover both sides of a part and the part may be subsequently plated as previously described.

In addition the process disclosed above may be utilized on non-reactive surfaces as well as reactive surfaces, may be utilized on new, but defective, castings to recover same as well as on old castings and may be utilized over new castings to produce a much more durable plated surface than has previously been known.

It is the intention to include all embodiments and modifications as are defined by the appended claims within the scope of the invention.

I claim:

1. A plated article having a reactive surface constructed of one of plastic, resin, aluminum, steel and zinc, comprising a cleaned article surface, a flame sprayed tin zinc metal coating which is over 50% tin by weight and four or more mils thick adhering to the cleaned article surface and chrome metal plating over the sprayed metal surface including copper cyanide, bright copper, semi-bright nickel, bright nickel and chrome layers.

2. Structure as set forth in claim 1, wherein the sprayed metal tin zinc coating is 60% tin and 40% zinc by weight.

3. Structure as set forth in claim 1, wherein the sprayed metal tin zinc coating is 80% tin and 20% zinc by weight.

4. The method of producing a metal plated article comprising the steps of acid stripping the article, cleaning the article with one of glass frit, glass beads and sand, blowing residual dirt off the article, baking the cleaned article for approximately one-half hour at 350° F., flame spraying the article with a tin zinc metal coating which is at least 50% tin by weight to a thickness of four or more mils, abrading the tin zinc coating to a desired shape and chrome plating the abraded article including in the chrome plating the successive steps of copper cyanide, bright copper, semi-bright nickel, bright nickel and chrome plating.

* * * * *